US005787904A

United States Patent [19]

Michaud

[11] Patent Number: 5,787,904

[45] Date of Patent: Aug. 4, 1998

[54] ADJUSTABLE HAIR HOLDER AND METHOD FOR RETAINING HAIR

[76] Inventor: Susan M. Michaud, 27 W. 164 Sunnyside Ave., Winfield, Ill. 60190

[21] Appl. No.: 732,519

[22] Filed: Oct. 15, 1996

[51] Int. Cl.[6] ..... A45D 8/36

[52] U.S. Cl. ..... 132/200; 132/148; 132/128; 132/274

[58] Field of Search ..... 132/101, 144, 132/148, 222, 128, 146, 274, 275, 273, 200, 126, 127

[56] References Cited

U.S. PATENT DOCUMENTS

| | | | |
|---|---|---|---|
| D. 300,675 | 4/1989 | Sacher . | |
| D. 315,967 | 4/1991 | Rizzuto et al. . | |
| D. 315,968 | 4/1991 | Rizzuto et al. . | |
| D. 316,161 | 4/1991 | Kuglen . | |
| D. 316,762 | 5/1991 | Rizzuto et al. . | |
| D. 347,493 | 5/1994 | Connolly . | |
| D. 362,318 | 9/1995 | Corriher . | |
| 1,540,102 | 6/1925 | Cohen | 132/128 |
| 1,645,138 | 10/1927 | Harkness | 132/144 |
| 2,386,682 | 10/1945 | Heineman | 132/101 |
| 4,745,933 | 5/1988 | Saenger . | |
| 4,753,252 | 6/1988 | Boxer . | |
| 4,976,277 | 12/1990 | Yasuda . | |
| 5,033,486 | 7/1991 | Finamore et al. . | |
| 5,062,436 | 11/1991 | Emsellem . | |
| 5,085,859 | 2/1992 | Halloran et al. . | |
| 5,119,847 | 6/1992 | Powell et al. . | |
| 5,126,126 | 6/1992 | Varaprath et al. . | |
| 5,152,984 | 10/1992 | Varaprath et al. . | |
| 5,173,290 | 12/1992 | Halloran et al. . | |
| 5,174,312 | 12/1992 | Adams . | |
| 5,181,530 | 1/1993 | Chou . | |
| 5,271,421 | 12/1993 | Videtzky . | |
| 5,301,696 | 4/1994 | Revson . | |
| 5,411,040 | 5/1995 | Forrest | 132/222 |
| 5,445,170 | 8/1995 | Yasuda . | |
| 5,454,385 | 10/1995 | George | 132/144 |
| 5,456,272 | 10/1995 | Johnson . | |
| 5,458,108 | 10/1995 | Jacobs . | |
| 5,464,030 | 11/1995 | Avellanet . | |
| 5,465,741 | 11/1995 | Dvorak | 132/275 |
| 5,465,742 | 11/1995 | Dudley . | |
| 5,472,003 | 12/1995 | Frame et al. . | |
| 5,595,199 | 1/1997 | Solomon et al. | 132/274 |

FOREIGN PATENT DOCUMENTS

| | | | |
|---|---|---|---|
| 869514 | 1/1942 | France | 132/128 |

*Primary Examiner*—Todd E. Manahan

*Attorney, Agent, or Firm*—Niro, Scavone, Haller & Niro

[57] ABSTRACT

An adjustable hair holder and method for same allows attractive, stylish hair retention comprising a comb, a restraint member, and a fabric or similar flexible midsection forming a pouch connecting the comb and restraint such that the restraint can secure a ponytail, the ponytail can be substantially surrounded and retained within the flexible midsection pouch, and the comb is placed at substantially the base of the ponytail to secure the hair in a fashionable, reliable holder. The pouch preferably includes elastic sides which secure the hair in a snug fashion which allows the invention to be utilized in health-conscious and safety-conscious environments such as food service establishments, hospitals, high-technology manufacturing facilities, etc.

13 Claims, 1 Drawing Sheet

ADJUSTABLE HAIR HOLDER AND METHOD FOR RETAINING HAIR

BACKGROUND OF THE INVENTION

Many types of hair retention devices exist to secure and restrain long hair, both for aesthetic purposes and for health, safety and convenience. None known to the inventor accomplish what the present invention accomplishes.

Hair retention is required or desired in many situations. Hospitals require long hair to be restrained for at least health reasons. Factories require long hair to be restrained for safety reasons. Food service establishments are required in many situations to have employees cover and constrain long hair. Many other situations require long hair to be restrained and contained for myriad reasons. In most of these situations, an inexpensive and reliable hair retention device is a necessity. Very often, the device employed is a plastic shower cap-type device or a paper disposable hat. These devices generally possess significant drawbacks including discomfort, lack of attractiveness, reliability in maintaining placement and hair retention ability, breathability and other shortcomings. The present invention solves the problems with the currently known hair retention devices while providing an attractive, inexpensive, reliable hair holder.

SUMMARY OF THE INVENTION

The present invention relates to a method and device for retaining hair and, more particularly, to restraining and substantially containing hair in a ponytail. The present invention provides an inexpensive, lightweight, easily transportable and fashionable hair retention device and method which can be used as a fashion accessory and wherever hair retention devices are required or desired. The device of the present invention comprises a comb, a strap or elastic loop, and a flexible material connecting the comb and strap whereby the ponytail is formed, and secured by the strap or elastic loop. The resulting ponytail is bunched or placed within the confines of the flexible material to form a pouch substantially containing the ponytail, and the comb is secured within the hair substantially at the base of the formation of the ponytail. The method of the present invention incorporates these steps to restrain hair.

DETAILED DESCRIPTION OF THE PREFERRED EMBODIMENT

Figure 1:
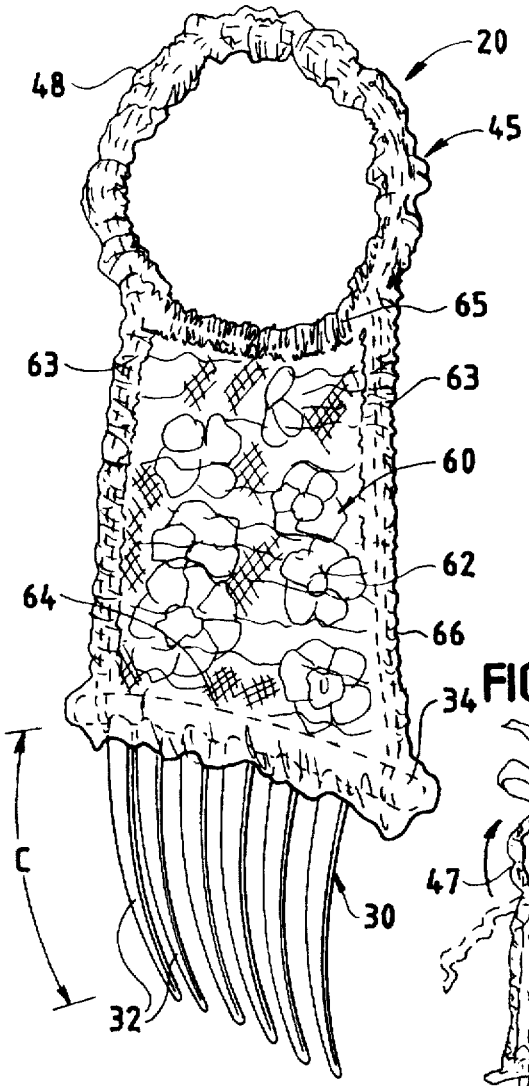
FIG. 1 is a perspective view of a preferred embodiment of the present invention.

The present invention, designated generally 20 in FIG. 1, provides a method and device for retaining and containing a length of hair. As best seen in FIG. 1, the device of the present invention includes a comb 30, an elastic or tiable restraint 45 and an intermediate pouch portion 60 constructed of cloth or other suitable material. Comb 30 is preferably plastic with a plurality of teeth 32 having a length D sufficient to remain placed in the hair. Comb 30 is also preferably curved to follow the form of a human head. Comb 30 comprises substantially solid body portion 34 from which teeth 32 depend.

Attached to comb 30 is intermediate pouch section 60 comprising a length of cloth 62 having sides 63, top 64 and bottom 65, a length L and a width W. Each side 63 of pouch 60 is elasticized along the entire length L.

Figure 7:
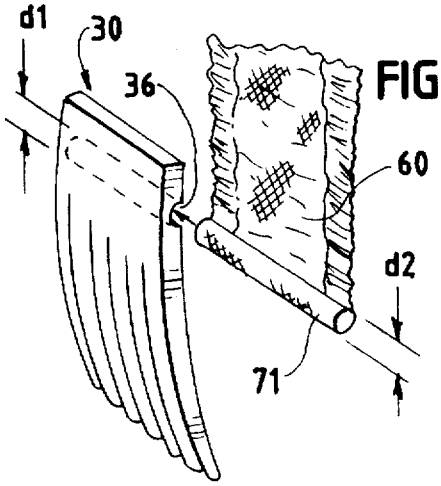
FIG. 7 is a perspective view of an alternative embodiment of the means for attaching the comb and flexible midsection of the present invention.

Pouch portion 60 is secured at its top 64 to body portion 34 of comb 30. Pouch 60 can be secured to comb 30 in many ways. First, the cloth of pouch 60 can be sewn to comb 30 by stitching the cloth between the teeth 32 of comb 30, as shown in FIG. 1. Second, as best seen in FIG. 7, comb 30 can be interchangeably attached to pouch 60 with bead 71 and slot 36. In this embodiment, top 64 of pouch 60 includes a bead 71 along the width W. Bead 71 has diameter d2 and is flexible but firm. Comb 30 includes along the entire length of body portion 34 a slot 36 having a diameter d1 substantially equal to or just greater than diameter d2 of bead 71. Slot 36 is formed in comb 30 such that an opening is formed along body portion 34 tangential to slot 36 and having a width less than diameter d2 of bead 71. Bead 71 is thus slidably engageable within slot 36 such that pouch 60 extends out the opening. Bead 71 and slot 36 thereby provide an attachment means to secure pouch portion 60 to comb 30. Such attachment means allows for interchangeability of comb 30 and pouch portion 60 for a variety of combinations of colors, styles and arrangements of uses of the present invention.

Figure 8:
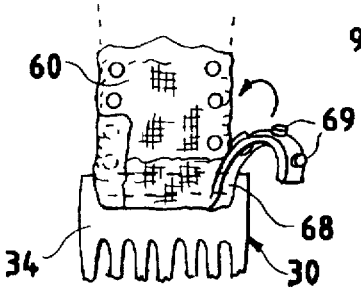
FIG. 8 is a rear, partial view of an embodiment of the comb and intermediate section of the present invention having snaps for attachment and adjustability.

Another attachment means, shown in FIG. 8, allows length-adjustable attachment of pouch portion 60 to comb 30. In this embodiment, a longitudinal aperture 68 is formed through body 34 of comb 30. Sides 63 of pouch portion 60 have snaps 69 thereon for mating engagement. In operation, top 64 of pouch portion 60 is threaded through aperture 68. Pouch 60 is then folded over body 34 of comb 30 and snapped via snaps 69 at a length preferable to the user. This securement method thus allows interchangeability of any comb 30 with any pouch portion 60 while also allowing the length to be modified such that the user can adjust the snugness of pouch portion 60 around the hair. Other attachment means as are well known to those of ordinary skill in the art, such as Velcro® or the like, are contemplated as suitable attachment means.

However attached, pouch portion 60 of the present invention is preferably cloth and ends at restraint 45. Sewn or alternatively integrated into sides 63 are of pouch 60 elastic members 66 along the length of pouch portion 60 extending from comb 30 to restraint 45. As will be explained below, elastic members 65 assist in containing hair within pouch portion 60 to provide safe, complete, fashionable hair retention.

Figure 5:
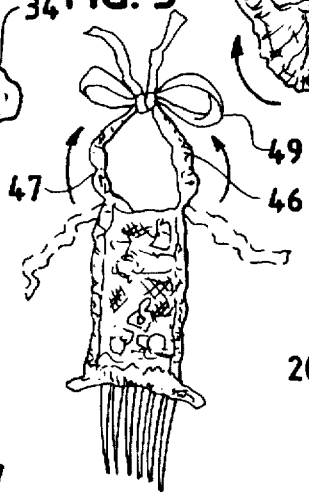
FIG. 5 is a rear view showing an alternative embodiment of the ponytail restraint of the present invention as a draw string forming a bow when applied.
Figure 4:
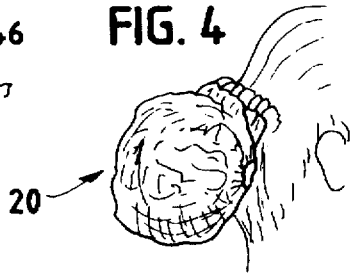
FIG. 4 is a perspective view of the present invention showing the restrained ponytail being secured with the comb of the present invention.

Pouch portion 60 ends at distal portion 65 from comb 30 at restraint 45. In one embodiment, as in FIG. 1, restraint 45 comprises an elastic loop 48 covered by an abundance of cloth material so as to allow elastic loop 48 to stretch. Elastic loop 48 is secured to pouch portion 60 by any suitable means such as being sewn together, or any other suitable means as is well known to those of ordinary skill in the art. Further, elastic loop 48 can form an integral part of pouch portion 60 where the cloth of bottom 65 of pouch portion 60 is formed into a circular sleeve which is sewn around the elastic loop. Another preferred embodiment includes pouch portion 60 terminating at bottom end 65 which is sewn as to form a sleeve 47 along the entire width thereof and having open ends 46. In this embodiment, as seen in FIG. 5, ribbon 49 or other securement means extends throughout sleeve 47 and out the ends 46 and has a length sufficient to tie a bow around a ponytail of hair.

Figure 2:
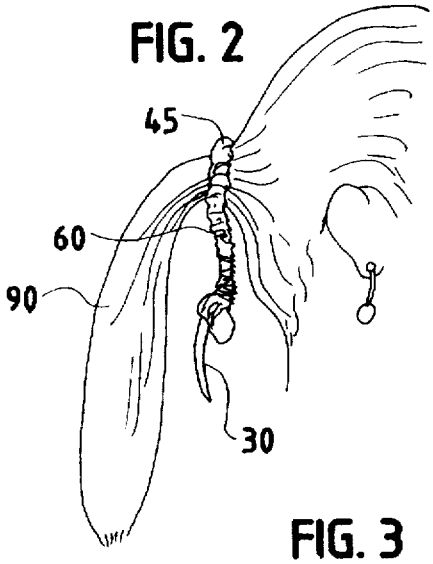
FIG. 2 is a side view of the present invention being applied to restrain a ponytail.

As described, the hair retention device of the present invention includes comb 30, pouch portion 60 and restraint member 45. In practice, as seen in FIGS. 2, 3, 4 and 6, the present invention works as follows to retain and contain a length of hair. A ponytail 90, as seen in FIG. 2, of hair is formed by a person wishing to contain his or her hair. Ponytail 90 is restrained at a location nearest the head by restraint member 45 of the present invention. As described, restraint member 45 may comprise enclosed elastic loop 48 or may comprise ribbon 49 or other means. Elastic loop 48 works to restrain ponytail 90 by placing ponytail 90 through loop 48. Elastic loop 48 can then, if desired, be twisted and placed around ponytail 90 several times to achieve the desired hold. If restraint member 45 is ribbon 49, ribbon 49 can be tied around ponytail 90 and placed in a bow or other configuration for aesthetic effect, preferably such that the bow is below ponytail 90 by wrapping ribbon 49 completely around ponytail 90 once before forming the bow.

Figure 3:
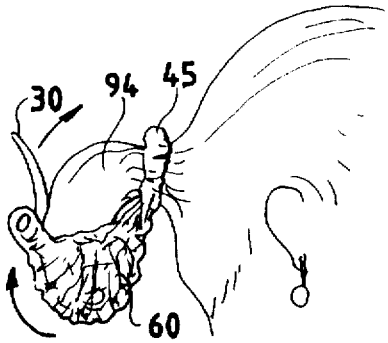
FIG. 3 is a side view showing the restrained ponytail being contained within the flexible midsection of the invention.
Figure 6:
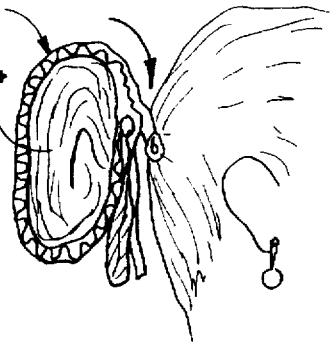
FIG. 6 is a side, cross-sectional view of an embodiment of the present invention in use.

Once ponytail 90 is restrained by restraint member 45, ponytail 90 can be wrapped or gathered to form a tuft 94 as seen in FIGS. 3 and 6. Tuft 94 is then placed within the confines of elastic members 66 of pouch portion 60. Comb 30 is then moved above tuft 94 and teeth 32 are placed in the hair at approximately where ponytail 90 begins and in front of restraint member 45. Teeth 32 of comb 30 work to secure tuft 94 within pouch 60. Further, elastic members 66 work to contain tuft 94 completely so as to prevent any exposure of any loose hair.

The present invention thus provides a device and method for the convenient, fashionable and reliable retention of a length of hair.

Of course, it should be understood that various changes and modifications to the preferred embodiments described herein will be apparent to those skilled in the art. Other changes and modifications, such as those expressed here or others left unexpressed but apparent to those of ordinary skill in the art, can be made without departing from the spirit and scope of the present invention and without diminishing its attendant advantages. It is, therefore, intended that such changes and modifications be covered by the following claims.

What is claimed is:

1. A hair retention device comprising:

a comb;

a restraint member comprising an adjustable band; and an intermediate pouch portion connecting the comb and restraint member wherein hair can be retained by said restraint member and contained within said intermediate pouch portion and secured by said comb.

2. The hair retention device of claim 1 wherein:

the comb further comprises a body portion and a plurality of teeth extending from the body portion and a longitudinal aperture extending through the body portion having a diameter D and having an opening along the entire aperture having a width substantially less than diameter D; and the pouch portion further comprises a bead having a diameter greater than the width of said opening opposite said restraint member removably engageable with said aperture.

3. The hair retention device of claim 1 wherein:

the comb comprises a body portion and a plurality of teeth and said body portion includes an aperture to receive said pouch portion; and the pouch portion includes snaps for adjustable attachment to said comb.

4. The hair retention device of claim 1 wherein the restraint member is an elastic loop.

5. The hair retention device of claim 1 wherein the restraint member is a length of flexible material.

6. The hair retention device of claim 1 wherein the restraint member is a ribbon.

7. The hair retention device of claim 1 wherein the pouch portion is cloth having a length and a width and sides, which sides are elasticized.

8. A method for retaining hair on a person's head comprising the steps of:

a. combining the hair into a ponytail;

b. restraining the ponytail with a restraint member to form a tuft of hair;

c. containing the tuft of hair within a constraint;

d. securing the contained hair by inserting a comb into the combined hair near the beginning of said ponytail.

9. The method of claim 8 wherein restraining the ponytail comprises tying a length of flexible material around said ponytail.

10. The method of claim 8 wherein restraining the ponytail comprises surrounding the ponytail with an elastic loop to crimp the ponytail.

11. The method of claim 8 wherein containing the tuft of hair comprises gathering the ponytail and placing the gathered ponytail into a pocket of material which fits snugly around the gathered ponytail.

12. The method of claim 8 further comprising the step of attaching a bow to the secured hair.

13. The method of claim 8 further comprising the step of attaching an ornament to the constraint of the secured hair.

* * * * *